US005889248A

United States Patent [19]

Plettner et al.

[11] Patent Number: 5,889,248

[45] Date of Patent: Mar. 30, 1999

[54] OPERATING MECHANISM FOR COMBINED INTERRUPTER DISCONNECT SWITCH

[75] Inventors: Horst Plettner, Hanau, Germany; Willie B. Freeman, Irwin; Jeffry R. Meyer, Greensburg, both of Pa.; Thomas Hertig, Winterthur, Switzerland; Anthony S. Masarik, Jeannette, Pa.

[73] Assignee: ABB Power T&D Company Inc., Raleigh, N.C.

[21] Appl. No.: 925,880

[22] Filed: Sep. 8, 1997

[51] Int. Cl.[6] ..... H01H 33/14; H01H 9/40

[52] U.S. Cl. ..... 218/7; 218/14; 218/84

[58] Field of Search ..... 218/7, 12, 13, 218/14, 67, 84

[56] References Cited

U.S. PATENT DOCUMENTS

| | | | |
|---|---|---|---|
| 2,394,086 | 2/1946 | Ludwig et al. . | |
| 2,556,056 | 6/1951 | Bally . | |
| 2,816,985 | 12/1957 | Lindell . | |
| 3,030,481 | 4/1962 | Gussow et al. . | |
| 3,116,391 | 12/1963 | Lindell et al. . | |
| 3,751,678 | 8/1973 | Kawasaki et al. . | |
| 4,049,936 | 9/1977 | Frink et al. . | |
| 4,110,579 | 8/1978 | Frink et al. . | |
| 4,126,773 | 11/1978 | Bernatt et al. . | |
| 4,223,191 | 9/1980 | Calvino . | |
| 4,283,610 | 8/1981 | Date et al. . | |
| 4,317,973 | 3/1982 | Golota | 200/153 P |
| 4,484,044 | 11/1984 | Yoshigae . | |
| 4,514,606 | 4/1985 | Veverka . | |
| 4,570,202 | 2/1986 | Nishida et al. . | |
| 5,243,159 | 9/1993 | Demissy . | |
| 5,410,116 | 4/1995 | Ozawa et al. | 218/67 |
| 5,493,090 | 2/1996 | Vestner et al. . | |
| 5,569,891 | 10/1996 | Freeman et al. . | |
| 5,629,869 | 5/1997 | Johnson et al. . | |
| 5,696,364 | 12/1997 | Stroud et al. | 218/2 |

*Primary Examiner*—Lincoln Donovan

*Attorney, Agent, or Firm*—Woodcock Washburn Kurtz Mackiewicz & Norris, LLP

[57] ABSTRACT

An apparatus for operating a combined interrupter disconnect switch is disclosed. The disconnect switch is operated by a slow speed linear motion of a mechanism pullrod. The interrupter, which is a component of the disconnect switch arm, is operated by a high speed linear motion of the same mechanism pullrod. In a preferred embodiment, the apparatus of the present invention comprises: an operating rod; a high speed operating mechanism connected to the operating rod; a sliding gear having an elongated gear face; a motor, rotatably connected to the sliding gear; a coupling gear drive having a longitudinally disposed threaded shaft and an external gear face, connected to the operating rod and meshed with said sliding gear; a threaded rod threaded into the threaded shaft of the coupling gear drive; and a drive rod connected to the threaded rod and to the mechanism pullrod. The high speed operating mechanism and motor respectively provide high speed and slow speed linear motion to the mechanism pullrod. The elongated gear face of the sliding gear permits decoupling of the high speed operating mechanism and slow speed motor, although both are acting on the same mechanism pullrod. In a preferred embodiment, the operating mechanism of the present invention also comprises upper and lower limit switches, controlled by a switch control bracket, for transmitting open and close commands to the high speed operating mechanism and motor.

16 Claims, 5 Drawing Sheets

OPERATING MECHANISM FOR COMBINED INTERRUPTER DISCONNECT SWITCH

FIELD OF INVENTION

This invention relates to disconnect switches with interruption capacity. More specifically, this invention relates to an operating mechanism for opening a circuit interrupter in a first range of its motion and for opening a disconnect gap in a second range of motion, and for reversing that operation during closing.

BACKGROUND OF THE INVENTION

A preferred application for the present invention is in high-voltage, three-phase combined circuit switchers. Therefore, the background of the invention is described below in connection with such devices. However, it should be understood that, except where they are expressly so limited, the claims at the end of this specification are not intended to be limited to applications of the invention in association with such devices.

In general, a combined circuit switcher combines two circuit breaking devices in series: an interrupter (for example, a $SF_6$ puffer interrupter), and a disconnect switch (for example, a lift arm with blade and jaw contacts). The interrupter is located inside an insulator which is also the lift arm of the disconnect switch. (i.e., a combined interrupter disconnect switch). Both breaking devices are driven by the same operating rod and connecting linkage.

To open the circuit, the operating rod must be pulled first at high speed to open the interrupter and then at slow speed to raise the switch arm and open the air disconnect switch. Similarly, to close the circuit, the operating rod must be pushed first at slow speed to lower the switch arm and close the disconnect switch and then at high speed to close the interrupter.

One type of combined circuit switcher for which the present invention is particularly suitable is a "V"-configuration combined circuit switcher (VCS). FIG. 1 shows a limited space application of a VCS designated generally as 100. Electrical energy flows from feeder 94, through VCS 100, to transformer 80, to an electrical load (not shown). VCS 100 is situated between transformer 80 and feeder 94 to break the circuit when desirable. Transformer bushing 82 sits atop transformer 80. Power line 84 is connected on one end to transformer bushing 82 and on the other end to a first terminal pad 116 on the VCS 100. Similarly, cable bushing 92 sits atop cable bushing support column 96. Power line 90 is connected on one end to cable bushing 92 and on the other end to a second terminal pad 104 on the VCS 100.

Another view of VCS 100 is provided in FIG. 2 which shows a typical VCS for a three phase power installation. A three phase power unit comprises three pole units 140A, 140B, and 140C: one pole unit for each power phase A, B, and C, respectively. The three pole units 140A–C are "gang-coupled" via interphase linkage 132. Interphase linkage 132 is also coupled to the operating rods 114A, 114B, and 114C of each of the pole units 140A–C, respectively. A single mechanism pullrod 300, also coupled to the interphase linkage 132, may be used to operate the breaking devices on all three pole units simultaneously.

As illustrated in FIG. 2, the VCS 100 is supported by a pair of support columns: left support column 128L and right support column 128R. An interphase linkage 132 is attached near one end 132L to the top of left support column 128L and near the other end 132R to the top of right support column 128R. A phase A pole unit 140A is located near the left end 132L of the interphase linkage 132, a phase B pole unit 140B is located near the center 132C of the interphase linkage 132, and a phase C pole unit 140C is located near the right end 132R of the interphase linkage 132.

A control cabinet 126 is located below the phase B pole unit 140B. The control cabinet 126 contains a combined operating mechanism (not shown in FIG. 2). The combined operating mechanism is the subject of the present invention and will be described in more detail below. A connecting support 130 is attached at its lower end 130L to control cabinet 126 and at its upper end 130U near the center of the interphase linkage 132C. The connecting support 130 contains the mechanism pullrod 300 that operates interphase linkage 132.

The components of a VCS pole unit 140 are illustrated in FIG. 1 which shows a side view of the VCS 100. The VCS pole unit 140 is substantially triangular in shape and comprises the following elements: station post insulator 102 which supports terminal pad 104 and jaw contact 106; support insulator 108 connected to lower bellcrank assembly 110 and to upper bellcrank assembly 112 and containing an operating rod 114; and combined interrupter disconnect switch arm 118 connected to upper bellcrank assembly 112 and comprising blade contact 120.

Disconnect switch arm 118 also contains a high speed interrupter. FIGS. 3A–3C, disclosed in U.S. Pat. No. 5,569,891 issued to Freeman et al., show a variety of cross sectional views of a typical high speed interrupter 10. The interrupter 10 provides two sets of contacts: arcing contacts 12 and 14, and main contacts 15 and 19. Arcing contacts 12 and main contacts 19 are movable to either close the circuit with respective contacts 14 and 15 or to open the circuit. FIG. 3A shows a cross section of the interrupter with its contacts closed; FIG. 3C shows a cross section of the interrupter with its contacts open.

The movable contacts 12 and 19 of high voltage circuit interrupters are subject to arcing or corona discharge when they are opened or closed, respectively. As shown in FIG. 3B, an arc 16 is formed between arcing contacts 12 and 14 as they are moved apart. Such arcing can cause the contacts to erode and perhaps to disintegrate over time. Therefore, a known practice (used in a "puffer interrupter" for example) is to fill a cavity 13 of the interrupter 10 with an inert, electrically insulating gas that quenches the arc 16. As shown in FIG. 3B, the gas is compressed by piston 17 and a jet or nozzle 18 is positioned so that, at the proper moment, a blast of the compressed gas is directed toward the location of the arc in order to extinguish it. Once an arc 16 has formed, it is extremely difficult to extinguish it until the arc current is substantially reduced. Once the arc 16 is extinguished as shown in FIG. 3C, the protected circuit is opened thereby preventing current flow.

As illustrated in FIG. 1, the circuit between feeder 94 and transformer 80 is closed when disconnect arm 118 is in the lowered position, with blade contact 120 engaging jaw contacts 106, and, as shown in FIG. 3A, movable contacts 12 and 19 engaging stationary contacts 14 and 15 within the interrupter.

To open the circuit, two sequential, linear movements of the mechanism pullrod 300 are required. First, the mechanism pullrod 300 must be moved in a first linear direction (downward, for example, as shown in FIG. 2) at high speed to open the interrupter 10. Then, the same mechanism pullrod 300 must be moved in the same linear direction (e.g., downward) at slow speed to raise the disconnect arm 118.

The interrupter 10 is opened by a high speed pull from the operating rod 114 acting on the upper bellcrank assembly 112. Upper bellcrank assembly 112, which comprises a system of levers (not shown), acts on arcing contacts 12,19 to open interrupter 10. Similarly, disconnect switch arm 118 is raised by a slow speed pull from the operating rod 114. A system of levers within lower bellcrank assembly translates the linear motion of the mechanism pullrod onto the operating rod.

Similarly, two sequential, linear movements of the mechanism pullrod 300 are required to close the circuit. First, the mechanism pullrod 300 must be moved in a second linear direction (e.g., upward as shown in FIG. 2) at slow speed to lower the disconnect arm 118. Next, the mechanism pullrod 300 must be moved in the same linear direction (e.g., upward) at high speed to close the interrupter 10.

Those skilled in the art will recognize that the rate at which the disconnect switch arm 118 is opened or closed is directly proportional to the rate at which the mechanism pullrod 300 is stroked. For a number of reasons it is undesirable to open or close the switch arm 118 too quickly. For instance, operating the switch arm 118 too quickly causes unnecessary wear on the blade contact 120 and jaw contacts 106, as well as on the other components of the switch arm 118. On the other hand, it is necessary to open and close the interrupter 10 quickly to control arcing. It should be understood that the rate at which the interrupter 10 is opened or closed is also directly proportional to the rate at which the mechanism pullrod 300 is stroked.

For example, the closing operation of a 145 kV VCS requires an initial slow speed stroke of the mechanism pullrod 300 to close the disconnect switch arm 118. This initial stroke is of about 176 mm linearly upward at about 38 mm/s. The interrupter 10 is then driven closed by a high speed stroke of the mechanism pullrod 300. The high speed stroke is of about 115 mm linearly upward at about 2–3 m/s. Similarly, the interrupter 10 is opened by an initial high speed stroke of the mechanism pullrod 300. This initial stroke is of about 115 mm linearly downward at about 4–6 m/s. Then the switch arm 118 is raised by a slow speed stroke of the mechanism pullrod 300. The slow speed stroke is of about 176 mm linearly downward at about 38 mm/s.

Those skilled in the art will recognize that the rate and distance parameters provided above will vary depending on the individual requirements of various combined circuit switchers. They are provided herein for purposes of clarity only and in no way limit the scope of the disclosed invention.

An operating mechanism which acts on a single mechanism pullrod to create a high speed linear motion of the mechanism pullrod in a first range of its motion and a slow speed linear motion of the same mechanism pullrod in a second range of its motion is desirable but, to the inventor's knowledge, is currently unavailable in the art.

Thus, there is a need in the art for an operating mechanism which opens a combined interrupter disconnect switch by acting on a mechanism pullrod to create a high speed linear motion of the mechanism pullrod, followed by a slow speed linear motion of the same mechanism pullrod. Further, there is a need in the art for an operating mechanism which closes a combined interrupter disconnect switch by acting on a single mechanism pullrod to create a slow speed linear motion of the mechanism pullrod followed by a high speed linear motion of the same mechanism pullrod.

SUMMARY OF THE INVENTION

The disclosed invention fulfills these needs in the art by providing an operating mechanism that combines two mechanical devices in series to drive a single mechanism pullrod at high speed in a first range of its linear motion and at slow speed in a second range of its linear motion. The two devices are combined in a manner which allows them to act independently of each other on the same mechanism pullrod.

A preferred embodiment of the invention is disclosed in which a high speed operating mechanism and a slow speed operating mechanism are coupled to the same mechanism pullrod. The slow speed operating mechanism comprises a sliding gear and motor for rotating the sliding gear to operate the disconnect switch arm by providing slow speed, substantially linear motion to the mechanism pullrod. Through an inventive coupling of the high speed and slow speed operating mechanisms, a single apparatus is provided which serves to drive the mechanism pullrod at the high speed required to operate the interrupter, as well as at the slow speed required to operate the disconnect switch arm.

The sliding gear has an elongated gear face that is meshed with a coupling gear face of a coupling gear drive. As the motor rotates the sliding gear, the coupling gear drive also rotates. The coupling gear drive also has a threaded shaft, into which a threaded rod is threaded. The mechanism pullrod is connected in series with the threaded rod via a drive rod extending from the threaded rod and connected to the mechanism pullrod. Thus, the rotational motion of the sliding gear creates a slow speed linear motion in the threaded rod and, consequently, in the mechanism pullrod. The high speed operating mechanism is connected to the coupling gear drive via an operating rod.

The elongated gear face of the sliding gear allows independent operation of the high speed and slow speed operating mechanisms. The coupling gear is free to move linearly at high speed while remaining meshed with the sliding gear. Thus, the motor may be activated to operate the disconnect switch arm by pushing or pulling the mechanism pullrod, while the operating rod connected to the high speed operating mechanism remains stationary.

Similarly, the coupling gear may be driven up and down, freely sliding on the sliding gear without being inhibited by the motor, as the interrupter is operated at high speed by the operating rod.

BRIEF DESCRIPTION OF THE DRAWINGS

The present invention will be better understood, and its numerous objects and advantages will become apparent by reference to the following detailed description of the invention when taken in conjunction with the following drawings, in which.

DETAILED DESCRIPTION OF THE PREFERRED EMBODIMENT

Figure 4:
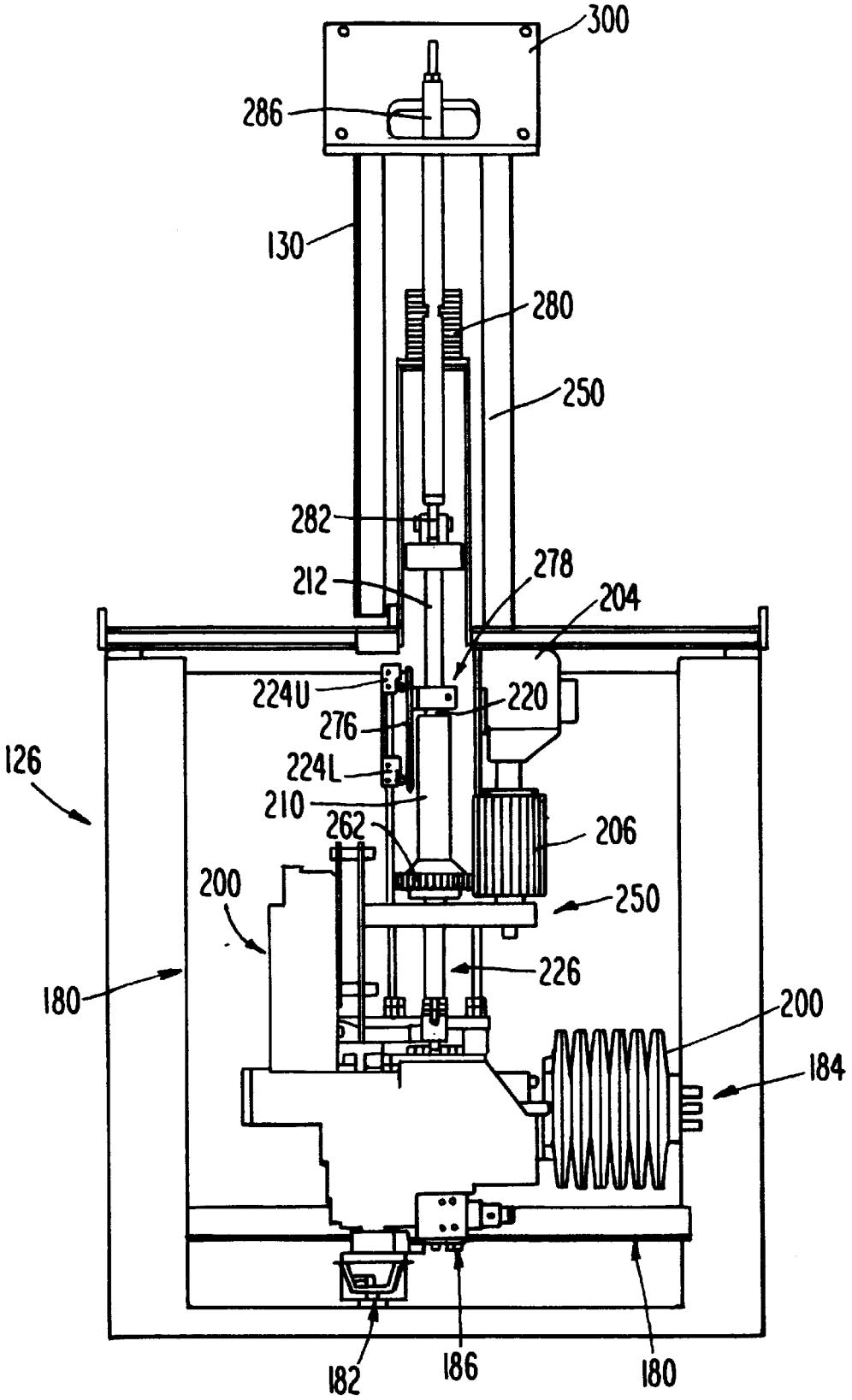
FIG. 4 shows a preferred embodiment of a combined operating mechanism according to the present invention.
Figure 5:
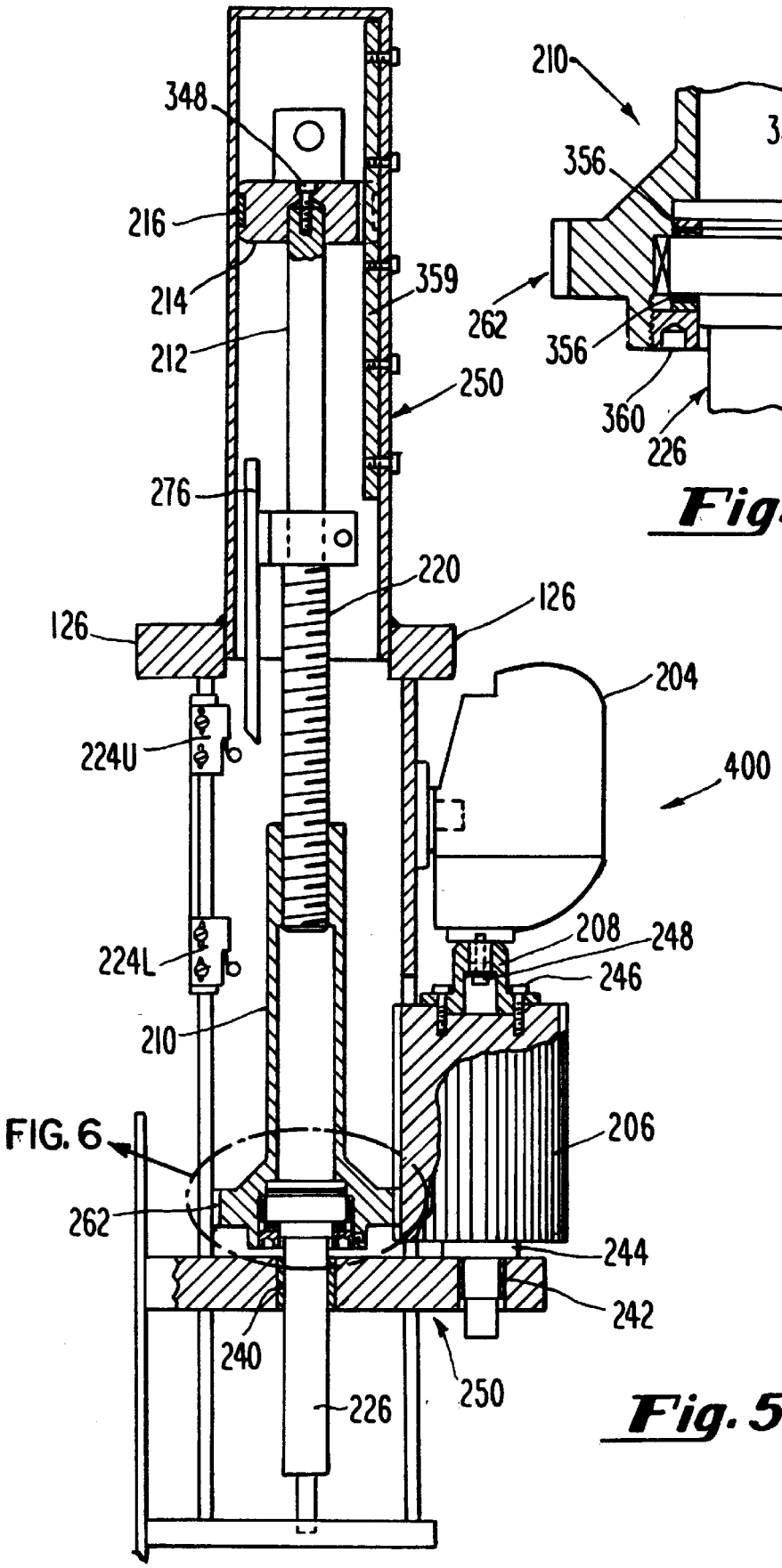
FIG. 5 shows a preferred embodiment of a slow speed operating mechanism according to the present invention.
Figure 6:
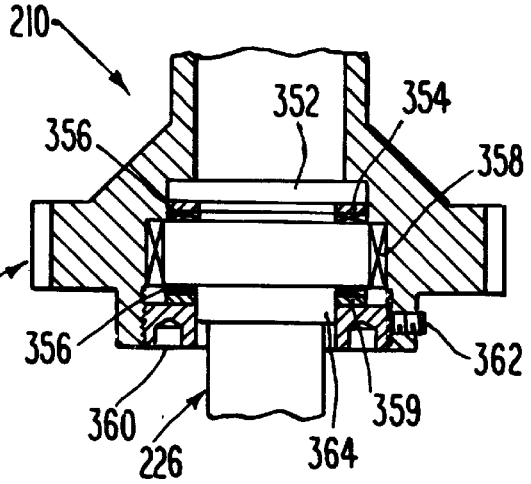
FIG. 6 is a cross sectional view of a preferred coupling between an operating rod and a coupling gear drive according to the present invention.

FIGS. 4, 5, and 6 show the operating mechanism of the present invention. As illustrated in FIG. 4, the operating mechanism is housed inside control cabinet 126, and mounted onto connecting support 130. Support 250 is attached to the bottom of connecting support 130. A high speed operating mechanism 200 is attached to support 250.

Operating rod 226 is attached to high speed operating mechanism 200 and extends substantially vertically therefrom. High speed operating mechanism 200 might be any standard hydraulic, pneumatic, or electromechanical device capable of providing high speed, substantially linear motion to operating rod 226. In a preferred embodiment, high speed operating mechanism 200 is an hydraulic mechanism. However, any high speed operating mechanism suitable for high voltage interrupter switching will function properly in combination with the slow speed gear system described more fully below. Hydraulic mechanisms using spring or pneumatic energy storage, spring-only mechanisms, or pneumatic or magnetic mechanisms would be suitable for this purpose. Since, as will be explained more fully below, the high speed operating mechanism and the slow speed operating mechanism are decoupled through the use of a sliding gear, the actual high speed operating mechanism used in practicing the disclosed invention is immaterial.

Operating rod 226 extends through base support 250 and is attached to coupling gear drive 210. Coupling gear drive 210 has a longitudinally disposed internal threaded shaft. Threaded rod 220 is threaded into the threaded shaft of coupling gear drive 210. Coupling gear drive 210 also has an external gear face 262 which is meshed with sliding gear 206. Sliding gear 206 is attached to base support 250 and to motor 204. Sliding gear 206 is substantially cylindrical in shape and has an elongated gear face 207 concentrically disposed about its longitudinal axis. As will be described in greater detail below, motor 204 provides rotational motion to sliding gear 206, which in turn provides rotational motion to coupling gear drive 210.

Figure 2:
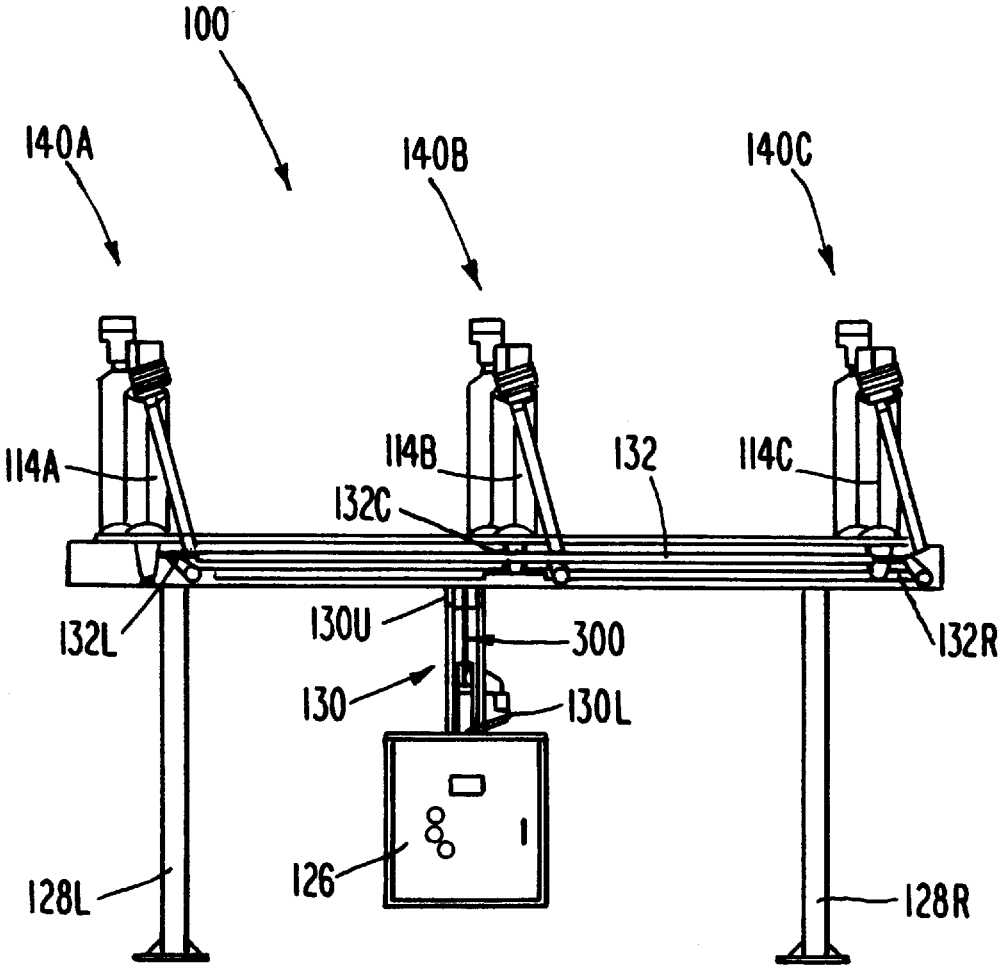
FIG. 2 shows a typical combined switcher for a three phase power installation in which gang-coupled VCS pole units are operated by a single mechanism pullrod.

Drive rod 212 extends substantially vertically from threaded rod 220 within connecting support 130. Thus, rotational motion in coupling gear drive 210 which causes threaded rod 220 to move linearly up or down also causes drive rod 212 to move linearly up or down. Mechanism pullrod 300 is coupled to drive rod 212 by coupling 282. Mechanism pullrod 300 extends substantially vertically within connecting support 130, exiting through the top of connecting support 130 where mechanism pullrod 300 is connected to interphase linkage 132 (not shown in FIG. 4; refer to FIG. 2). Thus, linear motion in threaded rod 220 is translated into linear motion in mechanism pullrod 300. Rubber boot 280 is located within connecting support 130 to protect the components located therein from the weather.

Limit switches 224U and 224L are attached to connecting support 130. Switch control bracket 276 is coupled to drive rod 212. As will be explained more fully below, the length of switch control bracket 276 and the distance between upper limit switches 224U and lower limit switch 224L are defined by the distance mechanism pullrod 300 must to be stroked at slow speed.

FIG. 5 shows the preferred embodiment of a slow speed operating mechanism 400 of the present invention in greater detail. Operating rod 226 extends through base support 250 and is coupled to coupling gear drive 210. The coupling between operating rod 226 and coupling gear drive 210 is shown in greater detail in FIG. 6 and described more fully below. To keep operating rod 226 steady and substantially vertical, bearings 240 are placed between operating rod 226 and base support 250. Threaded rod 220 is threaded into coupling gear drive 210. The external gear face 262 of coupling gear drive 210 is meshed with sliding gear 206.

Sliding gear 206 extends through base support 250. To reduce friction during rotation of sliding gear 206, washer 244 and bearings 242 are placed between sliding gear 206 and base support 250. Cap 208 couples sliding gear 206 to motor 204. Cap 208 is attached to sliding gear 206 by screws 246 and to motor 204 by screw 248.

Drive rod 212 extends substantially vertically from threaded rod 220. Switch control bracket 276 is attached to drive rod 212. Upper limit switches 224U and lower limit switch 224L are attached to base support 250. Piston 214 is attached to drive rod 212 by screw 248. Bearing 216 is placed between piston 214 and base support 250. Piston 214 is guided by bar 359 (which is attached to base support 250) and prevents rotation of drive rod 212.

Referring now to FIG. 6, to reduce wear and tear on the components, as well as to reduce energy losses, coupling gear drive 210 is snugly coupled to operating rod 226. As illustrated in FIG. 6, the top of operating rod 226 forms an operating rod cap 364. Coupling gear drive 210 is coupled to operating rod 226 using a plurality of thrust washers 354, needle roller bearings 356, a retainer plug 360, and a set screw 362. Needle roller bearings 356 and thrust washers 354 are placed between dust cover 352 and operating rod cap 364. Needle roller bearings 358 are placed between operating rod cap 364 and coupling gear drive 210. Needle roller bearings 356 and thrust washers 354 are placed between operating rod cap 364 and retainer plug 360. Retainer plug 360 is tightened until coupling gear drive 210 and operating rod 226 are snug. When retainer plug 360 has been tightened sufficiently, set screw 362 is tightened. Thus, coupling gear drive 210 remains coupled to operating rod 226.

Figure 1:
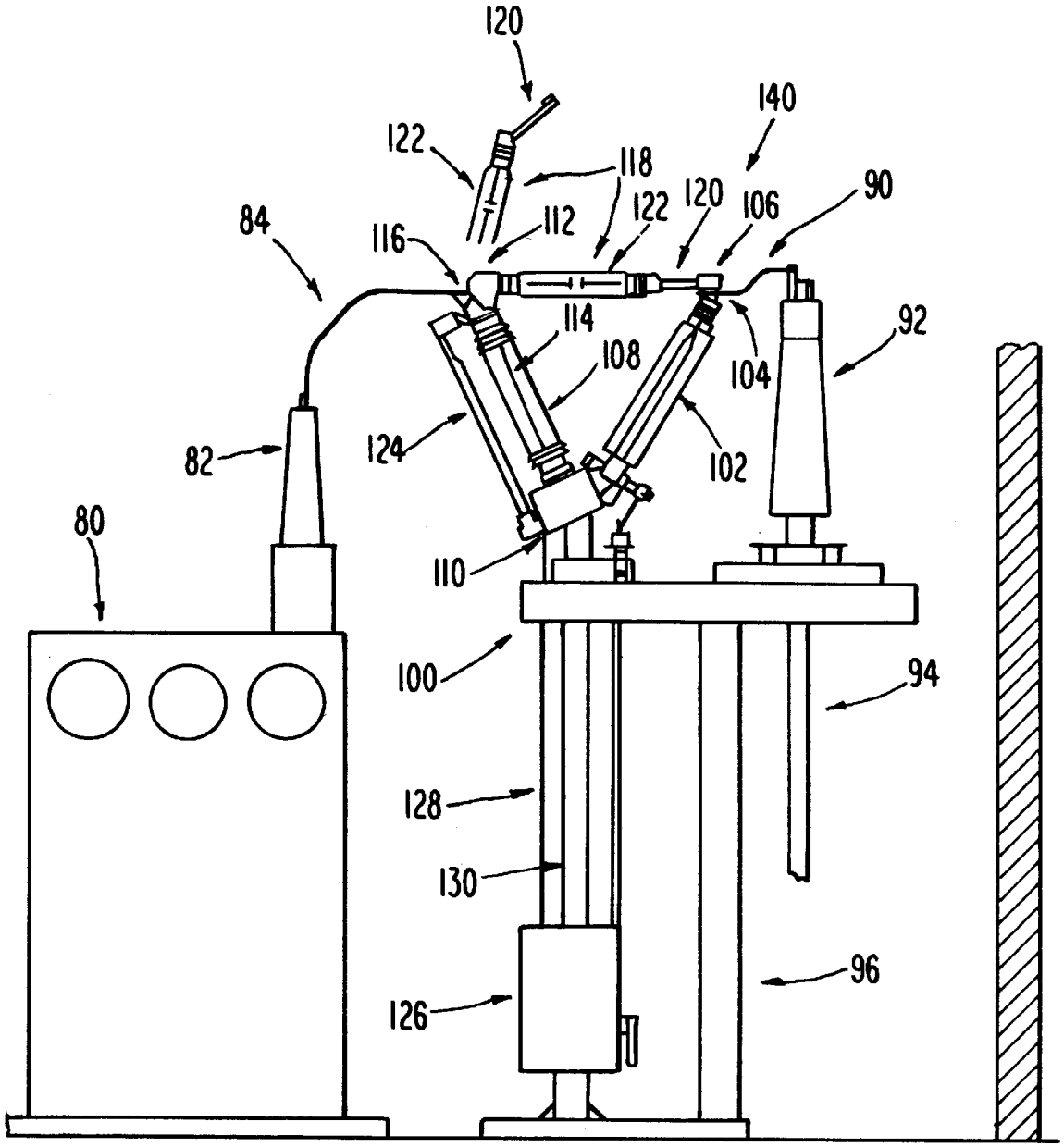
FIG. 1 shows a limited space application of a V-shaped combined circuit switcher (VCS)

The operating mechanism of the present invention is used preferably according to the following procedure. Assume that the combined interrupter disconnect switch is fully closed. That is, disconnect switch arm 118 is in the position shown in the lower portion of FIG. 1, and interrupter 10 is in the position shown in FIG. 3A.

To open the combined interrupter disconnect switch 100, an open signal is sent to the high speed operating mechanism 200. In a preferred embodiment of the present invention, a start button located on the control cabinet 126 is pushed. The start button is electrically connected to the high speed operating mechanism 200 so that pushing the start button causes an open signal to be sent to the high speed operating mechanism 200. It should be understood that other vehicles, such as remote communications channels, generally are used to send an open signal to the high speed operating mechanism 200.

Figure 3A:
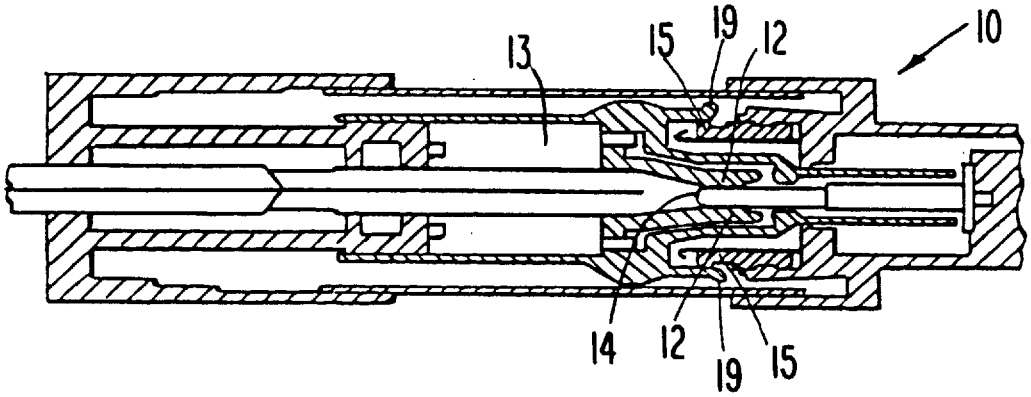
Fig. 3A (PRIOR ART)
FIG. 3A is a cross sectional view of a prior art interrupter with its contacts closed.
Figure 3B:
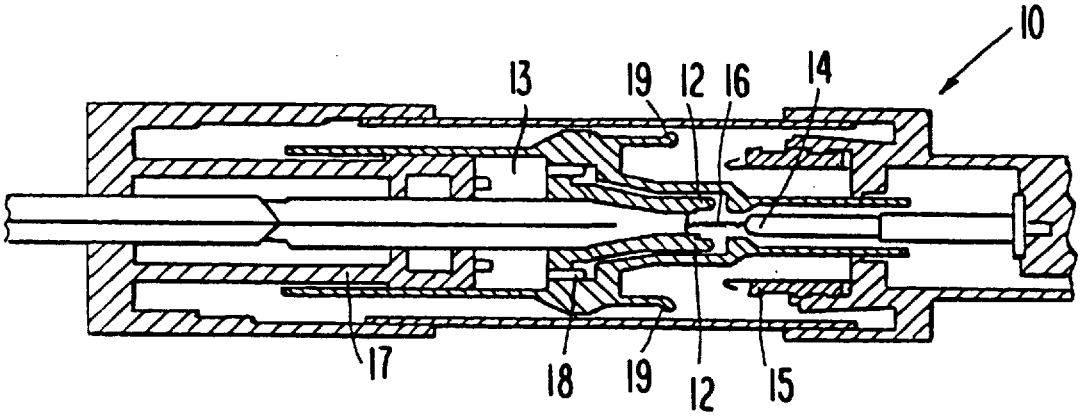
Fig. 3B (PRIOR ART)
FIG. 3B is a cross sectional view of a prior art interrupter with an arc formed between its arcing contacts.
Figure 3C:
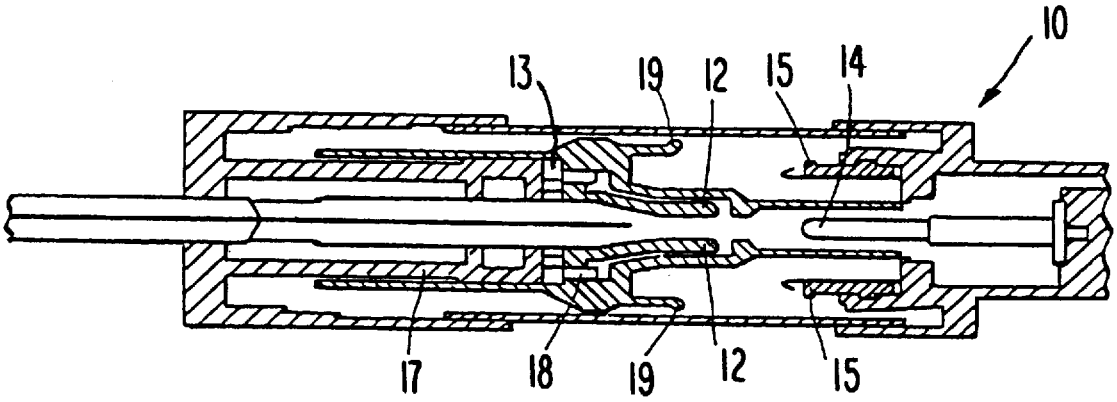
Fig. 3C (PRIOR ART)
FIG. 3C is a cross sectional view of a prior art interrupter with its contacts open.

High speed operating mechanism 200 responds to the open signal by pulling linearly downward on operating rod 226 at high speed. The downward motion of operating rod 226 causes a downward motion of mechanism pullrod 300, which causes interrupter contacts 12, 14, 15, and 19 to separate as shown in FIGS. 3B and 3C. The downward motion of operating rod 226 causes coupling gear drive 210 to move downward so that coupling gear face 262 is near the bottom of sliding gear 206 as shown in FIG. 4. Coupling gear face 262 and sliding gear 206 remain meshed. At this point, interrupter 10 is open (i.e., the contacts are separated), but disconnect switch arm 118 remains closed (i.e., blade contact 120 and jaw contacts 106 are engaged).

At the same time, the downward motion of operating rod 226 causes switch control bracket 276 to move downward. Switch control bracket 276 is set so that the bottom of the switch control bracket 276 trips upper limit switches 224U just as the high speed downward motion of operating rod 226 is complete (i.e., the interrupter contacts 12, 14, 15, and 19 have been opened completely). Upper limit switches 224 trigger motor 204 to start rotating sliding gear 206. The rotation of sliding gear 206 causes coupling gear drive 210 to rotate (since sliding gear 206 and coupling gear face 262 are meshed). The rotation of coupling gear drive 210 causes threaded rod 220 to rotate downwardly into the threaded shaft of coupling gear drive 210 at slow speed. The slow speed downward motion of threaded rod 220 causes a slow speed downward motion of drive rod 212 and, consequently, a slow speed downward motion of mechanism pullrod 300. The slow speed downward motion of mechanism pullrod 300 causes disconnect switch arm 118 to open (i.e., to disengage blade contact 120 from jaw contacts 106).

The downward motion of drive rod 212 causes switch control bracket 276 to continue to move downwardly. Motor 204 continues to rotate sliding gear 206 until the bottom of switch control bracket 276 trips lower limit switch 224L, at which point motor 204 stops. At this point, the combined circuit switcher is fully open. That is, disconnect switch arm 118 is in the position shown in the upper portion of FIG. 1, and interrupter 10 is in the position shown in FIG. 3C.

To close the combined interrupter disconnect switch, a close signal is sent to motor 204. In a preferred embodiment of the present invention, a stop button located on control cabinet 126 is pushed. The stop button is electrically connected to motor 204 so that pushing the stop button causes a close signal to be sent to motor 204. It should be understood that other vehicles, such as remote communications channels, might be used to send a close signal to motor 204.

Motor 204 responds to the close signal by rotating sliding gear 206 about its longitudinal axis. The rotation of sliding gear 206 causes coupling gear drive 210 to rotate (since sliding gear 206 and coupling gear 262 are meshed). The rotation of coupling gear drive 210 causes threaded rod 220 to rotate upwardly out of coupling gear drive 210 at slow speed. The upward motion of threaded rod 220 causes a slow speed upward motion of drive rod 212 and, consequently, a slow speed upward motion of mechanism pullrod 300. The slow speed upward motion of mechanism pullrod 300 causes a lowering of disconnect switch arm 118, thus engaging blade contact 120 into jaw contacts 106. At this point, disconnect switch arm 118 is closed (as shown in the lower portion of FIG. 1) but interrupter 10 remains open (as shown in FIG. 3C).

The upward motion of drive rod 212 causes switch control bracket 276 to move upward. Switch control bracket 276 is set so that the top of switch control bracket 276 releases upper limit switches 224U just as the slow speed upward motion of mechanism pullrod 300 is complete (i.e., disconnect switch arm 118 has been closed completely). Tripping upper limit switches 224U causes high speed operating mechanism 300 to begin to close interrupter 10.

Note, however, that in a preferred embodiment of the present invention, a time delay is introduced between the time motor 204 stops rotating sliding gear 206 and the time high speed operating mechanism 200 begins to close interrupter 10. A delay is desirable because disconnect switch arm 118, even though engaged into jaw contacts 106, tends to be somewhat unstable immediately after being lowered. If high speed operating mechanism 200 were to push mechanism pullrod 300 at high speed before disconnect switch arm 118 is stabilized, disconnect switch arm 118 would be slammed into place, thus causing undesirable wear and tear on disconnect arm 188, as well as blade contact 120 and jaw contacts 106. It has been observed that disconnect switch arm 118 takes about one-half of one-second to stabilize in jaw contacts 106. Therefore, in a preferred embodiment of the present invention, when switch control bracket 276 trips upper limit switches 224U, a delay of about one-half of one second is initiated before high speed operating mechanism 200 begins to close interrupter 10.

Note also that in a preferred embodiment of the present invention sliding gear 206 is stopped at a known location in its rotation after the low speed motion is completed. This is desirable so that the every time the combined interrupter disconnect switch is opened sliding gear 206 and, consequently, mechanism pullrod 300 begin in the same, known position. This is accomplished by exerting a short-duration reversing pulse on motor 204, causing sliding gear 206 immediately to reverse its rotational direction for an instant. The net result is that sliding gear 206 stops its rotation nearly immediately after the low speed motion has completed. Without this compensation, sliding gear 206 would continue to rotate for an unknown additional angular distance and, consequently, the position of mechanism pullrod 300 would be unknown as well. Thus, in a preferred embodiment of the present invention, when switch control bracket 276 releases upper limit switches 224U, a short-duration reversing pulse is exerted on motor 204, causing sliding gear 206 immediately to reverse its rotational direction for an instant.

After the aforementioned time delay, high speed operating mechanism 200 pushes operating rod 226 upward at high speed. The high speed, linearly upward motion of operating rod 226 causes a high speed upward motion of coupling gear drive 210, threaded rod 220, drive rod 212, and mechanism pullrod 300. The high speed upward motion of mechanism pullrod 300 causes interrupter contacts 12, 14, 15, and 19 to engage as shown in FIG. 3A. The upward motion of coupling gear drive 210 causes coupling gear face 262 to move to near the top of sliding gear 206. Coupling gear face 262 and sliding gear 206 remain meshed. At this point, the combined circuit switcher is in the fully closed position. That is, disconnect switch arm 118 is in the position shown in the lower portion of FIG. 1 and interrupter 10 is in the position shown in FIG. 3A.

While the invention has been described and illustrated with reference to specific embodiments, those skilled in the art will recognize that modification and variations may be made without departing from the principles of the invention as described hereinabove and set forth in the following claims.

We claim:

1. Apparatus for operating a combined interrupter disconnect switch, wherein the interrupter is a component of a disconnect switch arm of the disconnect switch, and wherein the interrupter is operated by a high speed linear motion of a mechanism pullrod, and wherein the disconnect switch is operated by a slow speed linear motion of the mechanism pullrod, said apparatus comprising:

a high speed operating mechanism for providing high speed, substantially linear motion to the mechanism pullrod;

a slow speed operating mechanism for providing slow speed, substantially linear motion to the mechanism pullrod, wherein said slow speed operating mechanism comprises a sliding gear, having a longitudinal axis, and having an elongated gear face concentrically disposed about its longitudinal axis; and, a motor, rotatably connected to said sliding gear, for rotating said sliding gear; and, coupling means for coupling said high speed and slow speed operating mechanisms to the mechanism pullrod.

2. The apparatus of claim 1, wherein said motor rotates said sliding gear in a first angular direction about its longitudinal axis in response to a first open command, and said motor rotates said sliding gear in a second angular direction about its longitudinal axis in response to a first close command.

3. The apparatus of claim 2, wherein said coupling means comprises:

a coupling gear drive having a coupling gear face, the coupling gear face of said coupling gear meshed with the elongated gear face of said sliding gear.

4. The apparatus of claim 3, wherein said coupling gear drive has a longitudinally disposed threaded shaft and said coupling means further comprises:

a threaded rod having first and second ends, the first end of said threaded rod threaded into the threaded shaft of said coupling gear drive.

5. The apparatus of claim 4, wherein a drive rod extends from the second end of said threaded rod and wherein said drive rod is coupled to the mechanism pullrod.

6. The apparatus of claim 5, wherein said coupling means further comprises:

an operating rod, attached to said high speed operating mechanism, and coupled to said coupling gear drive.

7. The apparatus of claim 6, wherein said high speed operating mechanism provides high speed, substantially linear motion to said operating rod in a first linear direction in response to a second open command, and wherein said high speed operating mechanism provides high speed, substantially linear motion to said operating rod in a second linear direction in response to a second close command.

8. The apparatus of claim 7, further comprising:

a switch control bracket, connected to said drive rod;

an upper limit switch, adjacent to said switch control bracket; and a lower limit switch, adjacent to said switch control bracket, and separated from said upper limit switch by less than the length of said switch control bracket.

9. The apparatus of claim 8, wherein said upper limit switch causes the first open command to be transmitted to said motor in response to being tripped by said switch control bracket, and wherein said upper limit switch causes the second close command to be issued to said high speed operating mechanism in response to being released by said switch control bracket.

10. The apparatus of claim 8, wherein said lower limit switch causes said motor to stop rotating said sliding gear in response to being tripped by said switch control bracket.

11. The apparatus of claim 10, further comprising:

an open button, electrically connected to said high speed operating mechanism, wherein pressing said open button causes the second open command to be sent to said high speed operating mechanism.

12. The apparatus of claim 10, further comprising:

a close button, electrically connected to said motor, wherein pressing said open button causes said second close command to be sent to said motor.

13. The apparatus of claim 1, wherein said high speed operating mechanism is hydraulic.

14. The apparatus of claim 1, wherein said high speed operating mechanism is pneumatic.

15. The apparatus of claim 1, wherein said high speed operating mechanism is electromechanical.

16. The operating mechanism of claim 1, wherein said high speed operating mechanism is magnetic.

* * * * *